United States Patent [19]

Brockhaus

[11] Patent Number: 4,864,689

[45] Date of Patent: Sep. 12, 1989

[54] ARRANGEMENT WITH DUAL HINGE ASSEMLIES FOR REMOVABLE MOTOR VEHICLE DOORS

[75] Inventor: Ernst Brockhaus, Remscheid-Hasten, Fed. Rep. of Germany

[73] Assignee: Ed. Scharwachter GmbH & Co. KG, Remsheid, Fed. Rep. of Germany

[21] Appl. No.: 188,683

[22] Filed: Apr. 20, 1988

Related U.S. Application Data

[63] Continuation of Ser. No. 905,574, Sep. 9, 1986, abandoned.

[30] Foreign Application Priority Data

Sep. 11, 1985 [DE] Fed. Rep. of Germany ..... 3532423

[51] Int. Cl.[4] ..... E05D 7/10

[52] U.S. Cl. ..... 16/262; 16/275; 16/381; 16/386; 49/381; 296/148

[58] Field of Search ..... 16/262, 263, 264, 275, 16/381, 386; 49/381, 388; 296/148, 202

[56] References Cited

U.S. PATENT DOCUMENTS 1,429,416 9/1922 Fade ..... 16/386
4,259,763 4/1981 Hsu ..... 16/386

FOREIGN PATENT DOCUMENTS 1459104 11/1968 Fed. Rep. of Germany ..... 16/386
2506130 8/1976 Fed. Rep. of Germany ..... 16/275

*Primary Examiner*—Richard K. Seidel
*Attorney, Agent, or Firm*—Toren, McGeady & Associates

[57] ABSTRACT

An arrangement for mounting doors on motor vehicles, wherein the doors may be removed during assembly and replaced in a desired mounted position on the vehicle including an upper and a lower hinge assembly with at least one screw bolt engaged in one of the assemblies along a common rotational axis for securing the door in its installed operating position. At least one of the hinge assemblies is provided with a first and a second commercial bearing part which are arranged in a forked configuration with a third commercial bearing part being operatively engaged between the first and second bearing parts in a free space therebetween. An axially adjustable bearing pin is arranged to extend through one of the first and second bearing parts to hold the door so as to be free from play and to secure the door in its installed operating position against unintentional removal.

19 Claims, 5 Drawing Sheets

ARRANGEMENT WITH DUAL HINGE ASSEMLIES FOR REMOVABLE MOTOR VEHICLE DOORS

This is a continuation of application Ser. No. 905,574, filed Sept. 9, 1986, now abandoned.

The present invention is directed generally to hinge mechanisms, particularly for removable doors of motor vehicles, which are articulated at a vehicle body. More specifically, the invention is directed to a hinge arrangement which includes an upper and a lower removable hinge assembly, wherein the two assemblies are arranged on a common rotational axis, and wherein the vehicle door is secured in its entirety in the installed operating position by means of at least one screw bolt which is assigned to one of the two hinges and is arranged in the common rotational axis of the two hinges.

In modern automobile construction, there continues to prevail a mode of manufacture in which vehicle doors, which are originally adjusted in an unfinished condition, are removed from the vehicle body during assembly of the interior fittings of the vehicle with the doors being once again reinstalled on the vehicle body subsequently in their originally adjusted position after the interior fitting of the vehicle is concluded.

A series of different structural types of removable door hinges are known for this purpose, wherein, in a first structural type of such door hinges, the two hinge wings are supported relative to one another so as to be rotatable about the hinge axis by means of a bearing pin or journal and a step bearing or bushing or the like recess.

In another type of structural arrangement for removable door hinges disclosed in DE-OS No. 1 459 104, two commercially available or vendor supplied parts, constituting bushing means, provided at one hinge wing, embrace a middle bushing member at the other hinge wing with a forked configuration. A free space is left open between the two bushing members and the other bushing part which engages between the two outer bushing parts is rotatably supported at one hinge wing by means of a hinge pin stub. It is held in its operating position by means of a screw bolt which is directed axially relative to the hinge axis so as to be free from play and so as to be secured against unintentional removal.

In a third known structure for a removable hinge, the bushing members of the two hinge wings which engage in one another are secured along the operating swivelling angle area of the hinge against unintentional removal by means of reciprocally arranged projections and recesses, which projections protrude radially relative to their bushing parts. Regardless of which structural type of hinge is selected, in particular for the hinge arrangement of a removable motor vehicle door, there exists a prerequisite for its application in the condition that the vehicle door occupy exactly its original adjusted position again without additional expenditure or adjustment when it is secured on its hinges after being removed from the vehicle body, e.g., during fitting of the interior of the vehicle. Moreover, it is desirable that, to the highest degree possible, the removal of the vehicle door as well as its reinstallation on its hinges be carried out with a minimum of expenditure of force and time and especially by means of mechanical assembly devices.

SUMMARY OF THE INVENTION

Accordingly, the invention is directed toward providing a hinge arrangement for removable motor vehicle doors which, with the use of simple and inexpensively produced hinges, enables easy and effortless removal and also easy and effortless reinstallation of the door, and, in particular, one which may be carried out with mechanical assembly devices and in which it is also insured, above all, that the door will occupy its originally adjusted position automatically and without further expenditure or adjustment after reinstallation and that, in so doing, the door is secured in its installed position against unintentional removal.

In accordance with the invention, the objectives thereof are met in that, in one of the hinge wings of at least one of the two hinge assemblies fastened at the door beam of the vehicle body, there are provided two bushing members which are commercially available parts which embrace a middle commercially available bushing member of the hinge wing fastened at the door. The two bushing members are arranged in a forked configuration and provide a certain free space therebetween. The door is held in the hinge bearings so as to be free from play by means of an axially adjustable or displaceable bearing pin which penetrates one of the two commercially available bushing members of the hinge wing on the body side and the door is secured in its installed operating position against unintentional removal.

In the arrangement according to the invention, each of the two hinge wings which are attached to the vehicle body has at least one lower bushing or bearing part in which is arranged a hinge pin stub which, in turn, engages an eye borehole of the bearing member of the hinge wing on the door side in such a way that the door is lifted out of the hinge bearing by means of lifting and can be removed from the body. Moreover, there is provided at at least one of the two door hinges a bearing pin which is arranged concentrically relative to the hinge axis and which is axially adjustable and which cooperates with the upper side of the bushing member of the hinge wing on the door side in such a way that the bushing member of the hinge wing on the door side is held against the lower bushing member of the hinge wing on the body side and the door is accordingly secured against unintentional removal. An adjustment of the swivelling bearing of the door which is free from play is also achieved simultaneously in both the upper and lower door hinge assemblies. A particular advantage is obtained in that only a bearing pin need be axially adjusted when installing the vehicle door in order to secure the vehicle door in its final operating position.

The invention may be applied in various embodiments and, in accordance with a further embodiment thereof, the second door hinge assembly is constructed as a simple removable hinge comprising a bearing pin arranged at a hinge wing and a bearing recess or step bearing arranged at the other hinge wing. It is preferred that a door hinge constructed in this manner be used as the upper door hinge since there is usually not sufficient room available in this area of the vehicle body to axially adjust an axially adjustable bearing pin by means of a work tool in a sufficient manner. The hinge assembly containing the axially adjustable bearing pin is accordingly preferably arranged as the lower hinge assembly, wherein the axially adjustable bearing pin is received in an upper bushing part of the hinge wing on the body side and is formed, in its simplest arrangement, by means of a screw bolt which can be secured in its respective adjusted position by a counternut.

In accordance with another embodiment of the invention, the hinge wings of the two hinge assemblies which are attached to the body of the vehicle in each instance are formed with two bushing or bearing members which embrace a middle bushing or bearing member of the hinge wing on the door side in a forked configuration with a certain free space and the upper surface of at least one of the two hinge wings on the door side comprises a bearing for an axially adjustable bearing pin which is received in the upper bushing of the hinge wing on the body side, the bearing being conically or spherically reduced from top to bottom. The bearing pin can have a radially projecting conical bearing part to which is assigned a correspondingly conical bearing recess in the upper side of the middle bushing member of the hinge wing on the door side.

In addition to the possibility of securing the bearing pin in its operating position, the bearing pin received in the upper bushing member of the hinge wing on the body side so as to be axially adjustable, by means of a securing device, such as, for example, a clamping or fastening screw or the like, which latter is received in the bushing member so as to be radially adjustable relative to the axis of its shaft portion and which engages in a circumferential groove inner shaft portion, there is the additional possibility in accordance with the invention that the bearing pin, which is axially adjustable in the upper bushing member of the hinge wing on the body side, is axially spring-loaded or mounted in the direction of the upper side of the middle bushing member of the hinge wing on the door side. Spring-loading is applied by means of a spiral, flat or flat-spiral spring which is supported at the upper bushing member of the hinge wing on the body side and acts on an outwardly projecting collar surface of the bearing pin.

However, regardless of which of the two aforementioned possibilities is applied in particular for securing the bearing pin in its working position assigned to the installed vehicle door, both of the structural embodiments have the advantage that no work tool is needed for axial adjustment of the bearing pin when using a hinge constructed in this manner as the upper door hinge. Rather, at most, a work tool for tightening the clamping or fastening screw may be needed, which work tool is applied radially relative to the hinge axis with sufficient room being available for this purpose in the area of the vehicle body. In door hinges in which the bearing pin is secured and held, respectively, in its working position by means of a clamping or fastening screw engaging in a circumferential groove of its shaft portion, it is provided in an additional structural arrangement that the flank surfaces of the circumferential groove in the shaft portion of the bearing pin be inclined in opposite directions and diagonally relative to the pin axis and the tip of the securing device, such as, for example, a clamping or fastening screw, have a correspondingly inclined circumferential surface such that the bearing pin is forced away in the direction of its counter-bearing surface at the middle bushing member of the other hinge wing by means of the securing device.

In another embodiment of the invention, it is provided additionally that both hinges have a hinge pin stub which is rotatably supported at a lower bushing part of the hinge wing on the body side, with the intermediary of the bearing bushes, so as to be maintenance free and which engages in an eye borehole in the middle commercial bushing part of the hinge wing on the door side, wherein, in this arrangement, the hinge pin stub is fastened in the eye borehole of the commercial bushing part of the hinge wing on the door side so as to be nonrotatable relative thereto. However, a structural form can also be carried out in an opposite manner, namely that the hinge pin stub be fastened so as to be reciprocally nonrotatable in the lower commercial bushing part of the hinge wing on the body side and the hinge pin stub is received in the eye borehole of the commercial bushing part of the hinge wing on the side of the door by means of bearing bushes so as to be rotatable relative thereto and so as to be maintenance free.

Moreover, in another embodiment, the commercial bushing part of the hinge wing on the door side is supported by means of a ball on the hinge pin stub at the lower commercial bushing part of the hinge wing on the body side. In the same manner, it can be provided that the bearing pin, which is received in the upper commercial bushing part of the hinge wing on the body so as to be axially adjustable, acts at the middle commercial bushing part of the hinge wing on the door side by means of a ball, wherein this commercial bushing part has a correspondingly constructed step bearing possibly with a portion of an eye borehole arranged prior in series. In order to increase the guiding ability, it can be provided in every case that a bearing bush which consists of maintenance-free material for the guiding of the hinge pin stub and of the axially adjustable bearing pin is arranged in the hinge eye borehole portion which is arranged prior to the respective ball. Moreover, it can, of course, also be provided that the step bearing receiving the ball be lined with a maintenance-free plastic material or be formed from such plastic material.

In accordance with a further aspect of the invention, it may also be provided that one of the two hinge assemblies is constructed as a sheet metal hinge and is structurally combined with a door fastener, wherein the door fastener can be constructed in a known manner by means of a torsion bar fastener, but wherein, it can also be provided that a leaf spring or other such system be arranged as a loading element for the door fastener.

Finally, a special advantage of the invention results in that at least one, and preferably both, of the hinge wings of each of the two hinge assemblies for the door hinge arrangement in accordance with the invention be formed in each instance from a portion of a continuous hinge section.

The various features of novelty which characterize the invention are pointed out with particularity in the claims annexed to and forming a part of this disclosure. For a better understanding of the invention, its operating advantages and specific objectives attained by its use, reference should be had to the drawings and descriptive matter in which there are illustrated and described the preferred embodiments of the invention.

DETAILED DESCRIPTION OF THE PREFERRED EMBODIMENTS

Figure 1:
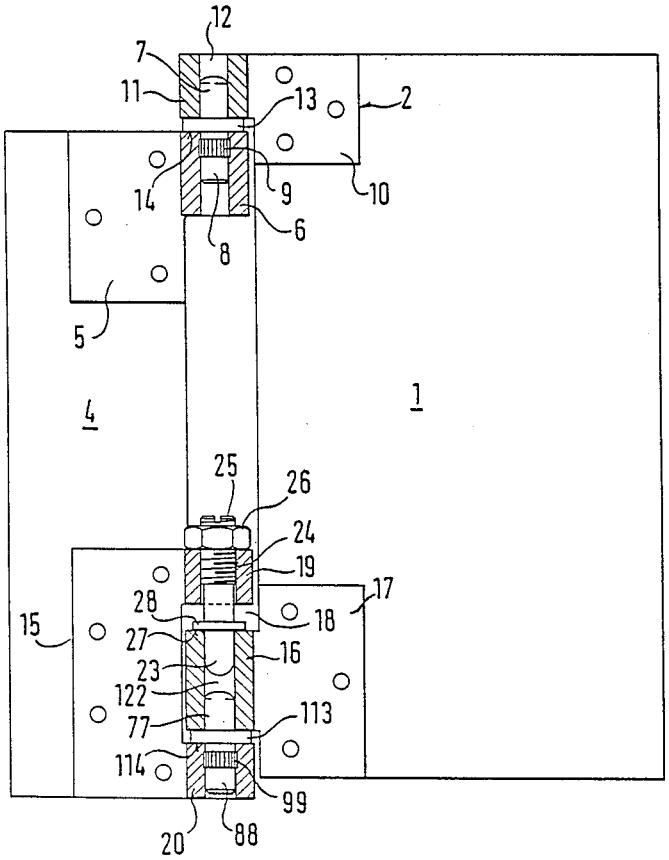
FIG. 1 is a schematic diagram partially in section showing a hinge arrangement for a removable motor vehicle door in accordance with the invention.

Referring now to the drawings, there is shown a hinge arrangement in accordance with the present invention for a removable motor vehicle door, wherein a vehicle door 1 is articulated at a door beam 4 of a vehicle body by means of a pair of hinge assemblies 2 and 3 arranged one above the other in the rotational axis of the door.

A first embodiment of the example is shown in FIG. 1, wherein the upper door hinge is formed by means of a simple removable hinge assembly consisting of a hinge wing 5 which is fastened at the door beam 4 of the vehicle body and which, in turn, has a lower commercially available bushing part 6 which receives a lower part 8 of a hinge pin 7 so as to be nonrotatably held relative thereto by means of a circumferential knurling 9. In addition, the hinge assembly 2 comprises a second hinge wing 10 which is fastened at the door 1 by means of a commercial part or bushing 11 which has a hinge eye borehole 12 in which the hinge pin 7 engages. Additionally, the hinge pin 7 is provided with a radially projecting collar 13 by means of which it is supported in the axial direction at the upper side 14 of the commercial bushing part 6. The hinge arrangement for the removable motor vehicle door 1 comprises, additionally, a hinge assembly 3 which is arranged below the assembly 2 having one hinge wing 15 fastened at the door beam 4 and having two commercial bushing parts 19 and 20 arranged a distance from each other and extending in a forked configuration to embrace a middle commercial bushing part 16 of a hinge wing 17 fastened at the motor vehicle door 1 with a certain free space 18. A hinge pin stub 77 is fastened in the lower commercial bushing part 20 of the hinge wing 15 so as to be nonrotatable relative thereto by means of a shaft portion 88 and a circumferential knurling 99. The hinge pin stub 77, in turn, engages in an eye borehole 122 of the commercial bushing part 16 of the hinge wing 17 on the door side. The hinge pin stub 77 is supported against an upper side 114 of the commercial bushing part 20 by means of a radially projecting collar 113. The upper commercial bushing part 19 of the hinge wing 15 on the body side is penetrated by a bearing pin 23 constructed as a screw bolt and received by means of a threaded borehole 24 in the commercial bushing part 19 so as to be axially adjustable. The bearing pin 23 has a shaft part 25 which is provided externally with a thread which cooperates with the threaded borehole 24 of the commercial bushing part 19 and which can be fixed in the respective adjusted position by means of a counternut 26. The bearing pin 23 acts at the upper side 27 of the middle commercial bushing part 16 of the hinge wing 17 by means of a radially projecting collar 28. The entire hinge arrangement of the removable motor vehicle door is, accordingly, adjustable so as to be free from play on the one hand and so as to be secured against unintentional removal on the other hand.

Figure 2:
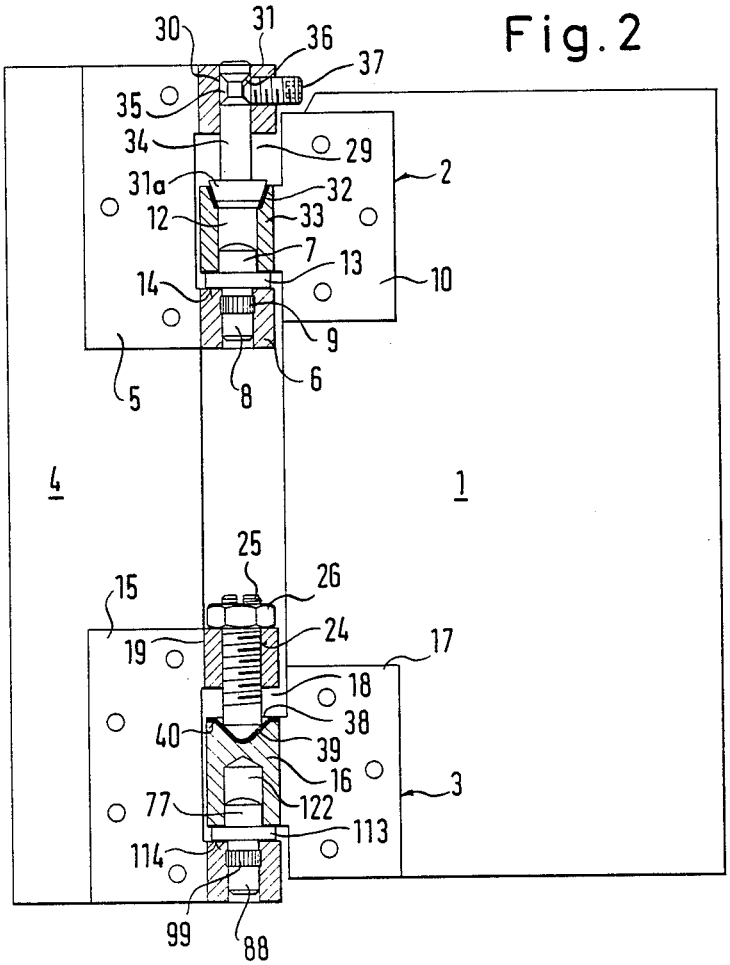
FIG. 2 is a similar view showing another structural form of a hinge arrangement.

In the embodiment shown in FIG. 2, it is provided in a bearing of the middle commercial bushing parts 33 and 16 of the hinge wings 10 and 17 on the door side, which bearings are constructed in an identical manner, that the upper hinge assembly 2 is also provided with an axially adjustable bearing pin 29. The bearing pin 29 extends through an eye borehole 30 in the upper commercial bushing part 31 of the hinge wing 5 on the body side and engages in a conically structured step bearing 32 at the upper end of the middle commercial bushing part 33 of the hinge wing 10 on the door side by means of a correspondingly, conically-shaped head end 31*a*. The middle commercial bushing part 33 of the hinge wing 10 is provided with a through-going hinge eye borehole 12. In its shaft part 34, the bearing pin 29 has a radially circumferential groove 35 with flank surfaces 36 sloping inwardly so as to be inclined in opposite directions relative to the hinge axis. A clamping or fastening screw 37 is arranged cooperatively with the circumferential groove 35 of the bearing pin 29 and the screw 37 is arranged so as to be radially adjustable relative to the groove 35 in the commercial bushing part 31 of the hinge wing 5 on the body side, and which, in turn, comprises circumferential surfaces which are directed in an opposite direction relative to the surfaces 36 of the radially directed circumferential groove 35 of the bearing pin 29 so that the bearing pin 29 is forced away in an axially direction toward the step bearing 32 by means of the fastening screw 37 from which there results an adjustment of the hinge bearing at least for the upper hinge assembly, which adjustment is free from play.

In the embodiment according to FIG. 2, the lower hinge assembly comprises a bearing pin 25 which is arranged so as to be axially adjustable in the upper commercial bushing part 19 by means of a threaded borehole and an external thread and which can be secured in the respective adjusted position by means of a counternut 26 and whose lower end 38 is spherically structured and cooperates with a correspondingly spherical step bearing 39 in the upper surface 40 of the commercial bushing part 16 of the hinge wing 17 on the door side.

Figure 3:
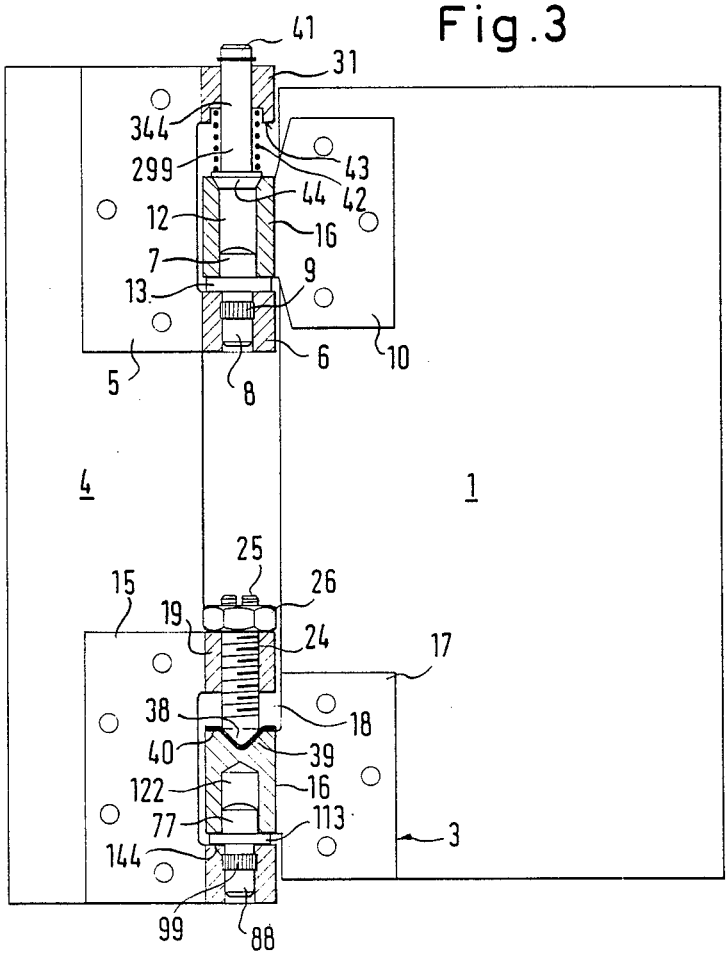
FIG. 3 is a view showing a variation for the hinge arrangement according to FIG. 2.

In the hinge arrangement of the embodiment shown in FIG. 3, many of the parts are identical with those shown in FIG. 2, but, in FIG. 3, it is provided that a bearing pin 299 which is received in the upper commercial bushing part 31 of the hinge wing 5 on the body side so as to be axially adjusted is received in a borehole recess 41 of the upper commercial bushing part 31 of the hinge wing 5 so as to be axially adjustable and displaceable and it is held in its position in which it cooperates with the upper surface or upper side, respectively, of the middle commercial bushing part 16 of the hinge wing 10 on the door side by means of a spiral spring. The spiral spring 42 is supported near underside 43 of the upper commercial bushing or bearing part 31 of the hinge wing 5 on the body side and acts at a radially projecting collar 44 of the bearing pin 299. It can easily be seen from a comparison of FIGS. 2 and 3 that no special working tool is needed for axial adjustment of the bearing pin 29 and 299, respectively, in the upper hinge assembly 2 since the bearing pins are brought into contact with the upper side of the middle commercial bearing part 16 of the hinge wing 10 on the door side either by means of a spring force or by means of a radially arranged and, accordingly, also radially adjustable, fastening or clamping screw, the contact being free from play.

Figure 4:
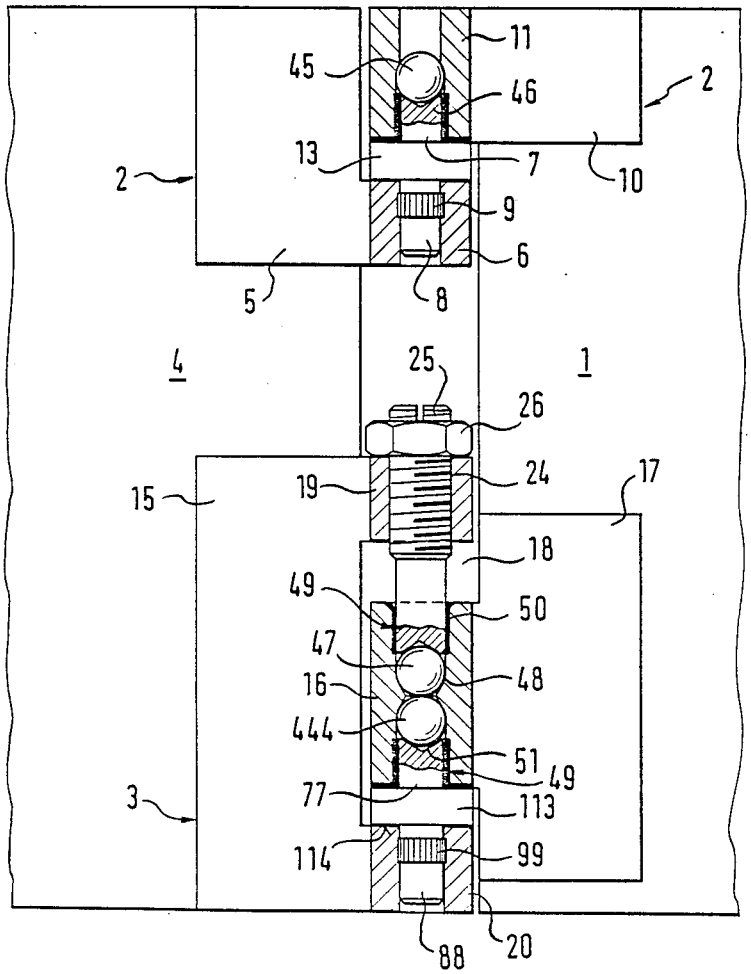
FIG. 4 is a sectional view showing another variation of a hinge arrangement according to FIG. 1.

In the embodiment of the invention shown in FIG. 4, the commercial bearing part 11 of the hinge wing 10 of the upper door hinge assembly 2, which hinge wing 10 is mounted on the door side, is supported on the hinge pin stub 7 by means of a ball 45. The hinge pin stub 7 is provided with a correspondingly constructed step bearing which, in turn, is either lined with plastic material or formed from a plastic material 46. In the embodiment shown, the lower hinge assembly likewise comprises a bearing pin 25 which is arranged in the upper commercial bearing part 19 of the hinge wing 15 mounted on the body side so as to be axially adjustable by means of a screw-thread arrangement 24 and which, in turn, acts at the commercial bearing part 16 of the hinge wing 17 on the door side via a ball 47. A correspondingly constructed step bearing 48 in the commercial bearing part 16 is assigned to the ball 47 and an eye borehole 49 which is, in turn, lined by means of a bearing bush 50 of maintenance-free bearing material, is arranged prior to this step bearing 48. The hinge pin stub 77 is received, in this embodiment, by means of a bearing bush 49 of maintenance-free bearing material in a correspondingly constructed borehole recess 122 of the middle commercial bearing part 16 of the hinge wing 17 mounted on the door side and comprises at its upper end a spherical step bearing 51 in which a second ball 444 is received. The step bearing 51 can either consist in its entirety of maintenance-free plastic material or it can be provided with a lining of maintenance-free plastic material.

Figure 5:
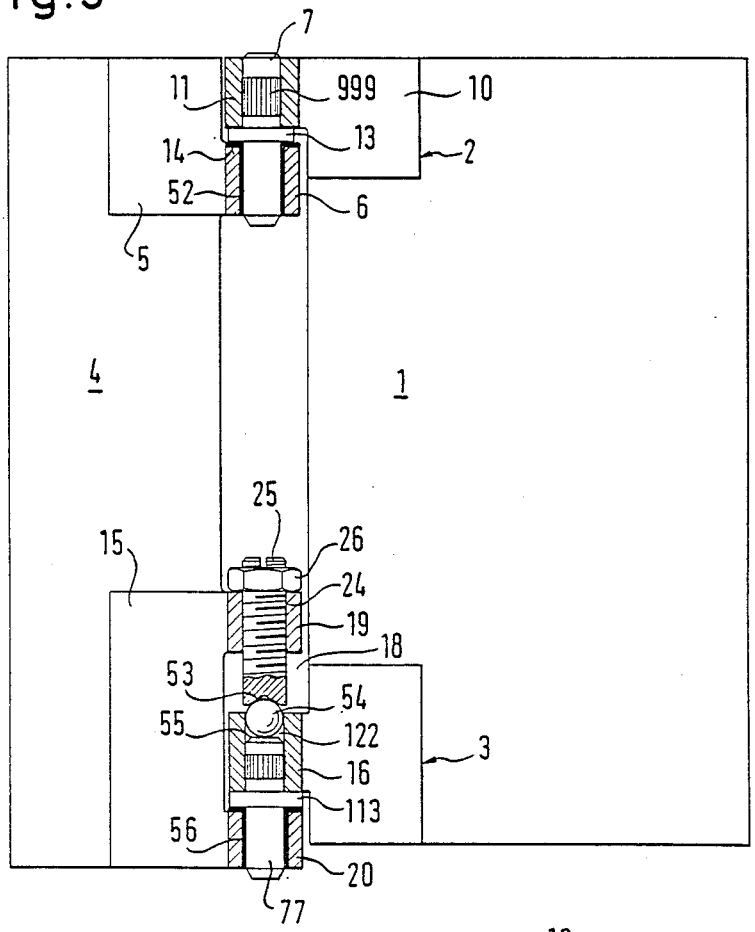
FIG. 5 is a view partially in section showing a further embodiment of the invention comprising a variation of the device shown in FIG. 1.

In an embodiment shown in FIG. 5, the hinge pin stub 7 of the upper door hinge assembly 2 is fastened so as to be reciprocally nonrotatable by means of a knurling 999 in the commercial bearing part 11 of the hinge wing 10 mounted on the door side and it is rotatably supported in the commercial bearing part 6 of the hinge wing 5 mounted on the body side by means of a bearing bush 52 so as to be maintenance-free. The axially adjustable bearing pin 25 of the lower hinge assembly 3 is provided at its lower front end with a step bearing 53 which is shaped particularly in the manner of an acute angle and by means of which it cooperates with a ball 54 which engages, in turn, in an eye borehole 122 of the commercial bearing part 16 of the hinge wing 3 on the door side and is supported at the upper front face 55 of the hinge pin stub 77. As a result, the hinge pin stub 77 is received in the eye borehole 122 of the commercial bearing part 16 of the hinge wing 3 mounted on the door side so as to be nonrotatable relative thereto and it is rotatably received in the commercial bearing part 20 of the hinge wing 15 which is mounted on the door beam side by means of a bearing bush 56 so as to be maintenance free.

Figure 6:
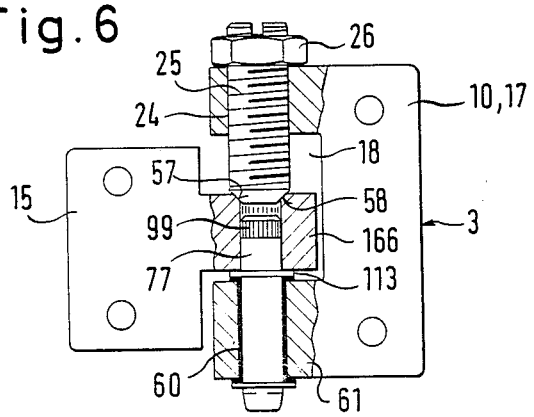
FIG. 6 is a partly cutaway side view showing an individual drawing of a removable door hinge assembly.

Additionally, it will be seen from the view of FIG. 6 that the invention also comprises an arrangement in which the bearing pin 25 is received so as to be axially adjustable in a commercial bearing part, in the case depicted, this being the upper commercial bearing part of the hinge wing which is fastened at the door side. This is accomplished by means of a threaded borehole 24 and the pin 25 cooperates by means of a conically constructed front face 57 with a correspondingly conical step bearing recess 58 in the middle commercial bearing part 166 of the hinge wing 15 mounted on the body side. Although the arrangement depicted in FIG. 6 is shown for the lower hinge wing assembly 3, it should be noted that it need not be exclusively provided therefor.

The hinge pin stub 77 is also received in the commercial bearing part 166 of the hinge wing 15 mounted on the body side by means of a circumferential knurling 99 so as to be nonrotatable relative thereto. On the other hand, the hinge pin stub 77 is rotatably received in the commercial bearing part 61 of the hinge wing 10/17 mounted on the door side by means of the bearing bush 60 so as to be maintenance free.

Figure 7:
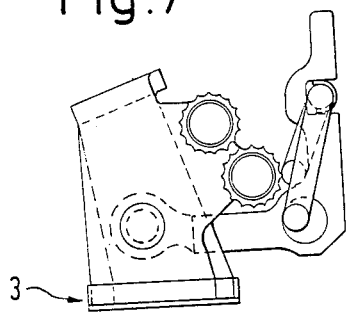
FIG. 7 is a top view of a removable door hinge which is structurally combined with a door fastener.
Figure 8:
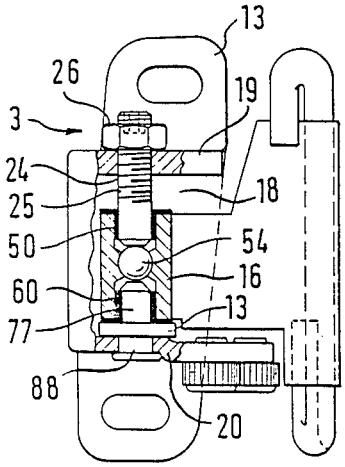
FIG. 8 is a partially cutaway side view of the device shown in FIG. 7.

In the individual views of FIGS. 7 and 8, there are shown structures directed in each instance to the arrangement of a door fastener which is structurally combined with one of the two door hinges showing not necessarily a typical, but an exemplary application of a torsion bar door fastener. The torsion bar door fastener is structured in a manner known per se, but is shown here only as a schematic example. At least one of the two hinge wings 10 or 15 is constructed as a sheet metal hinge and is equipped with a hinge bearing for the other hinge wing 10 or 17 approximately according to the embodiment depicted in FIG. 4. Of course, any other suitable embodiment type of a hinge bearing shown above can also be applied.

In addition, another special characteristic feature of the invention is that the embodiments of the upper and lower door hinge assemblies depicted and described are exchangeable and interchangeable with one another such that the upper door hinge assembly may be formed in accordance with the embodiments shown in FIGS. 1 to 6, while the lower door hinge assembly can be of another structural type such as embodiments shown in FIGS. 1–6 or vice versa.

While specific embodiments of the invention have been shown and described in detail to illustrate the application of the inventive principles, it will be understood that the invention may be embodied otherwise without departing from such principles.

What is claimed is:

1. A hinge mechanism for mounting a removable door to a door beam of a motor vehicle body comprising:

an upper and a lower hinge assembly, each including a first hinge wing mounted to said vehicle door and a second hinge wing mounted to said door beam, said hinge assemblies being arranged on a common rotational axis forming an axis of rotation for said door;

at least one screw bolt operatively engaged in one of said upper and lower hinge assemblies and arranged to extend along said common rotational axis of said hinge assemblies for securing said door against unintentional removal in its installed operating position in its entirety;

first and second commercial bushing parts provided in said second hinge wing of at least one of said hinge assemblies, said first and second commercial bushing parts being arranged spaced apart in a forked configuration in the direction of said common rotational axis to provide a free space therebetween;

a third commercial bushing part in said first hinge wing of said one hinge assembly operatively arranged between said first and second commercial bushing parts in said free space;

an axially adjustable bearing in arranged to extend through one of said first and second commercial bushing parts to hold said door so as to be free from play and to secure said door in its installed operation position against unintentional removal;

a hinge pin stub having a length which is greater than its diameter in order to support radial forces located in said second bushing part, said third bushing part being axially spaced from said first bushing part at a distance essentially corresponding to the axial length of said hinge pin stub extending from said second bushing part;

said screw bolt being axially adjustable and being provided in said first bushing part of said hinge wing, which axially adjustable screw bolt penetrates the latter, said screw bolt being provided as a precaution against removal for the entire door hinge arrangement and serving at the same time to insure an arrangement of the two hinges when the door is installed, which engagement is free of play; and said hinge pin stub being provided with a radially projecting collar resting against the commercial part of at least one of the hinge halves of the two hinges, the radially projecting collar serving to support the axial forces of the door hinge arrangement.

2. A mechanism according to claim 1, wherein the other of said hinge assemblies is constructed as a simple removable hinge with a bearing pin arranged at one of the hinge wings thereof and with one of a bearing recess or step bearing arranged at the other hinge wing thereof.

3. A mechanism according to claim 1, wherein said one hinge assembly is said lower hinge assembly, wherein said first and second commercial bushing parts comprise an upper and a lower commercial bushing part and wherein said axially adjustable bearing pin is arranged to extend through said upper commercial bushing part.

4. A mechanism according to claim 1, wherein said axially adjustable bearing pin is formed by means of a screw bolt which is adapted to be secured in a respective adjusted position by means of a counternut.

5. A mechanism according to claim 1, wherein said first and second commercial bushing parts are provided in said second hinge wings of both said upper and lower hinge assemblies arranged spaced apart in said forked configuration and wherein at least one of said first hinge wings is formed with an upper bearing surface for said axially adjustable bearing pin which is received in said upper bearing surface so as to be axially adjustable, said upper bearing surface being formed with a generally conical configuration.

6. A mechanism according to claim 5, wherein said bearing pin of said upper hinge assembly comprises a lower end having a radially projecting conical bearing part with a correspondingly constructed conical bearing recess being provided for cooperative engagement with said radially projecting conical bearing part in the upper side of the third commercial bushing part of the first hinge wing of the upper hinge assembly.

7. A mechanism according to claim 5 or 6, wherein said bearing pins of said upper and lower hinge assemblies are received in an upper one of said first and second commercial bushing parts in the second hinge wings of said hinge assemblies so as to be axially adjustable, said bearing pins being secured in their operating position by means of a securing device received in said upper commercial bushing part so as to be radially adjustable relative to the axis of a shaft portion and which engages in a circumferential groove of said shaft portion.

8. A mechanism according to claim 7, wherein flank surfaces of said commercial groove in said shaft portion of said bearing pin are inclined in opposite directions and wherein a tip of said securing device comprises a correspondingly inclined circumferential surface such that said bearing pin is forced away in a direction of a counter-bearing surface by means of said securing device.

9. An arrangement according to claim 1, wherein said first and second commercial bushing parts consists of an upper bushing part and a lower bushing part and wherein said bearing pin is received in said upper commercial bushing part so as to be axially adjustable, said bearing pin being spring-loaded in a direction of an upper side of said third commercial bushing part.

10. An arrangement according to claim 9, wherein the axially directed spring loading of said bearing pin which is received in said upper commercial part of said second hinge wing so as to be axially adjustable is applied by means of a spiral spring which is supported at the underside of said upper commercial bushing part and acts upon a collar surface of said bearing pin.

11. An arrangement according to claim 1, wherein said upper and lower hinge assemblies have a hinge pin stub which is rotatably supported at one of said first and second commercial bushing parts with the intermediary of a bearing bushing so as to be maintenance-free and which is received in an eye borehole of said third commercial bushing part.

12. An arrangement according to claim 11, wherein said hinge pin stub is fastened in said eye borehole of said third commercial bushing part so as to be nonrotatable relative thereto.

13. An arrangement according to claim 11, wherein said hinge pin stub is fastened in said lower commercial bushing part so as to be nonrotatable relative thereto and is rotatably received in said eye borehole of said third commercial bushing part by means of a bearing bushing so as to be maintenance free.

14. An arrangement according to claim 13, wherein said third commercial bushing part is supported by means of a ball on said hinge pin stub at one of said first and second commercial bushing parts.

15. An arrangement according to claim 14, wherein said bearing pin which is received in said upper commercial bushing part acts at said third commercial bushing part by means of a ball.

16. An arrangement according to claim 15, wherein said bearing pin extends through said axial eye borehole in said third commercial bushing part.

17. An arrangement according to claim 16, wherein said eye borehole in said third commercial bushing part is lined with a bearing bushing of maintenance free bearing material wherein said bearing bushing has a smaller diameter.

18. An arrangement according to claim 1, wherein one of said upper and lower hinge assemblies is constructed as a sheet metal hinge assembly and is structurally combined with a door fastener.

19. An arrangement according to claim 18, wherein said door fastener is constructed as a torsion bar door fastener.

* * * * *